US005735086A

United States Patent [19]

Fordahl

[11] Patent Number: 5,735,086

[45] Date of Patent: Apr. 7, 1998

[54] COMBINATION ROOF LOUVER AND ATTIC ACCESS HATCH

[76] Inventor: Reuben Monrad Fordahl, Box 84, Parkers Prairie, Minn. 56361

[21] Appl. No.: 514,962

[22] Filed: Aug. 14, 1995

[51] Int. Cl.[6] ..... E04B 7/18; E04D 13/03; F24F 7/02

[52] U.S. Cl. ..... 52/19; 52/72; 52/198; 52/199; 154/195; 154/270; 154/339

[58] Field of Search ..... 52/19, 72, 199, 52/198, 200; 454/339, 366, 254, 270, 275, 195, 199

[56] References Cited

U.S. PATENT DOCUMENTS

| | | | |
|---|---|---|---|
| 2,137,751 | 11/1938 | Davis | 52/19 |
| 2,692,548 | 10/1954 | Knorr | 454/366 |
| 3,093,059 | 6/1963 | Metz | 454/366 |
| 3,665,661 | 5/1972 | Beckerer | 52/19 |
| 3,742,659 | 7/1973 | Drew | 52/19 |
| 3,896,595 | 7/1975 | Anghinetti et al. | 52/19 |
| 4,297,818 | 11/1981 | Anderson | 454/366 X |
| 4,928,441 | 5/1990 | Daley | 52/19 |

*Primary Examiner*—Christopher T. Kent

[57] ABSTRACT

A combination roof louver that ventilates an attic and an attic access hatch for providing entry by a person into the attic. The device consists of two main parts, a base and a cover. The base of the device provides an entrance into an attic, and has a flange around its periphery which is to be installed under a roof covering. The cover has ventilating apertures in a soffit located underneath an outside edge. The cover pivots to open and close. The cover can also be removed.

12 Claims, 1 Drawing Sheet

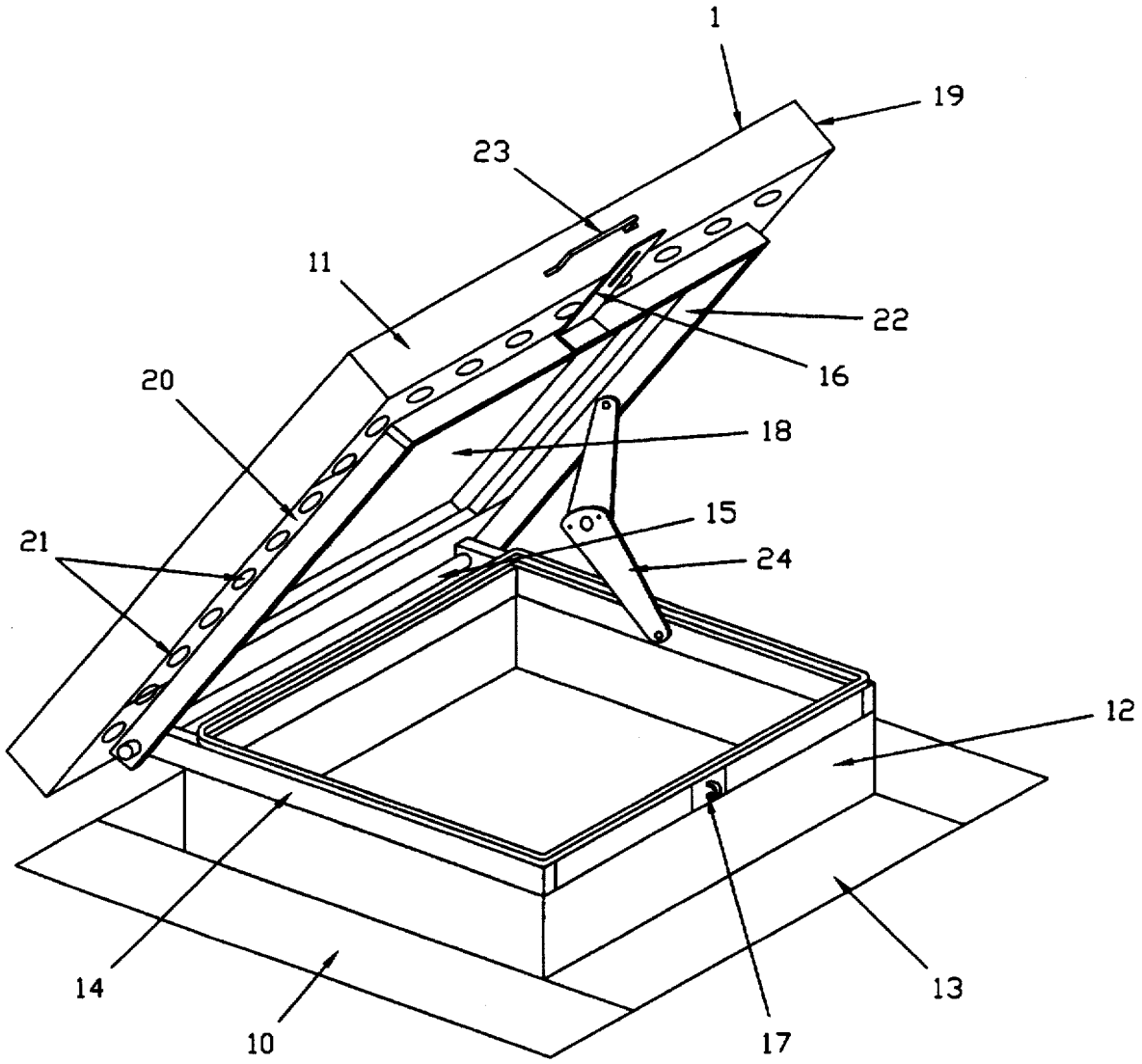
1
19
23
11
22
16
20
18
15
21
24
12
14
13
10
17

COMBINATION ROOF LOUVER AND ATTIC ACCESS HATCH

BACKGROUND OF THE INVENTION

The present invention generally relates to a combination roof louver and attic access hatch that ventilates an attic and which can be used for access into an attic.

DESCRIPTION OF THE PRIOR ART

It is common in the construction industry to provide roof louvers for ventilating the attics of building structures having pitched roofs. Some known roof louvers are provided under the soffit of the edge of the roof of a building structure. Other known roof louvers which are mounted on the upper surface of a roof include a turbine type, which has a rotating element which helps draw out air from within the attic of a building structure, and a non-movable louver which includes passive vents. It is also known in the construction industry to provide access hatches for entry into an attic. The present invention includes the combination of a roof louver which also provides an access hatch for entry into an attic.

SUMMARY OF THE INVENTION

The primary object of the present invention is to provide a roof louver which allows air exchange for ventilation of the attic of a building structure, and which also opens, enabling access to the attic of the building structure. The roof louver of the present invention can be locked in a closed position to prevent unwanted entry of weather elements such as rain. In addition, the roof louver of the present invention is large enough to allow access therethrough for entry of a person into the attic of a building structure. This access feature would be useful for electricians, plumbers, insulators, and even firemen, who could use this feature to extinguish attic fires without the need for creating a hole in the roof. The roof louver of the present invention can be made in any of various shapes or sizes without deviating from the basic design principles disclosed herein. Further, the roof louver of the present invention can be inexpensively manufactured from different commonly available materials such as wood, plastic and aluminum.

BRIEF DESCRIPTION OF THE DRAWING

FIG. 1 shows a perspective view of a combination roof louver and attic access hatch in an open position in accordance with the present invention.

DETAILED DESCRIPTION OF THE PREFERRED EMBODIMENT

FIG. 1, shows the roof louver 1 of the present invention in an open position. The roof louver 1 has two main sections, a base 10 and a cover 11. The base 10 includes an upstanding frame 12 with four sides forming a curb, and a flange 13 for providing flashing which extends around the four sides of the frame 12 and which protrudes outwardly for installation under roofing material, such as shingles. The frame 12 also has an upper edge 14. Two of the opposing sides of the upper edge of the frame 12 extend beyond ends of one of the remaining two sides of the frame 12 for providing the mounting of hinge pins 15 which allow the cover 11 to be hingedly mounted and pivoted on the base 10. A hasp 16 is provided on the cover 11 in operative alignment with an eye 17 mounted on the base 10 for providing a locking means in order to lock down the cover 11 in a closed position. It is also contemplated that the cover 11 may be fixed in a closed position using clamps instead of the hinge, hasp and eye arrangement.

The cover 11 includes a lid 18 which has a fascia 19 extending around the perimeter of the lid 18 at a generally perpendicular orientation with respect to the lid 18. Extending from substantially the opposite end of the fascia 19 from the lid 18, and in an orientation generally perpendicular to the fascia 19, is a soffit 20 which is located around the perimeter of the cover 11. The soffit 20 includes a plurality of ventilating apertures 21 which are provided with bug screening which allow air to pass therethrough and which prevent entry of insects and other pests. At the end of the soffit 20 opposite the fascia 19, a rim 22 is provided at a generally perpendicular orientation with respect to the soffit 20. Two opposing sides of the rim 22 also extend beyond one of the remaining two sides of the rim 22 to provide a location for mounting the hinge pins 15 corresponding to the similar structure on the base frame upper edge 14. The cover 11 also includes a handle 23 and a lid support 24 for holding the cover 11 in an open position.

In operation, attic air enters the roof louver 1 and exits through the ventilation apertures 21 provided in the soffit 20. The cover 11 is opened by disengaging the hasp 16 from the eye 17, and by lifting the handle 23 until the cover 11 is in an open position, thereby providing an attic access hatch. The open position is maintained by the lid support 24. This allows entry of a person into the attic from the upper surface of the roof of the building structure.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A combination roof louver and attic access hatch apparatus for use on an upper surface of a roof of a building structure, said roof being covered with a roofing material, said apparatus being for use in ventilation of an attic and access for entry of a person into an attic, said apparatus comprising:

a base including a frame defining an aperture for allowing entry of a person into an attic of a building structure from an upper surface of a roof; and a cover hingedly attached to said frame for providing a pivoting motion to open and close said apparatus, said cover including a lid;

a fascia extending perimetrically around said lid, said fascia being attached to and generally oriented perpendicularly with respect to said lid; and a soffit extending perimetrically around said fascia, said soffit being attached to and generally oriented perpendicularly with respect to said fascia, and said soffit including a plurality of ventilating apertures for allowing air which has entered said apparatus from an attic to be exhausted to a location outside said attic.

2. The apparatus of claim 1, further comprising a handle attached to said cover for enabling opening of said cover with respect to said base.

3. The apparatus of claim 1, further comprising a locking means including a hasp located on said cover in operative alignment with an eye located on said frame.

4. The apparatus of claim 1, further including a flange extending perimetrically around said frame, said flange being attached to and oriented generally perpendicularly with respect to said frame and providing a flashing for installment underneath a roofing material.

5. The apparatus of claim 1, wherein said frame includes a perimetrically surrounding upper edge having two opposing sides which extend beyond another side of said upper edge.

6. The apparatus of claim 5, wherein said two opposing sides define locations for receiving hinge pins.

7. The apparatus of claim 6, wherein said cover further includes a rim attached to and extending generally perpendicularly from said soffit; said rim including two sides providing locations for receiving hinge pins and corresponding to said two opposing sides of said frame.

8. The apparatus of claim 7, wherein two hinge pins are provided at said locations for receiving hinge pins.

9. The apparatus of claim 1, wherein said apparatus defines a generally rectangular shape.

10. The apparatus of claim 9, wherein said generally rectangular shape is a square.

11. The apparatus of claim 1, further including a lid support for maintaining the cover in an open position.

12. The apparatus of claim 11, further including bug screening covering said ventilation apertures in order to prevent insects and other pests from entering the apparatus.

* * * * *